US010800499B2

(12) United States Patent
Kamei

(10) Patent No.: US 10,800,499 B2
(45) Date of Patent: Oct. 13, 2020

(54) LIFE JACKET

(71) Applicant: Takashina Life Preservers Co., Ltd., Osaka (JP)

(72) Inventor: Yuki Kamei, Hyogo (JP)

(73) Assignee: Takashina Life Preservers Co., Ltd., Osaka (JP)

( * ) Notice: Subject to any disclaimer, the term of this patent is extended or adjusted under 35 U.S.C. 154(b) by 0 days.

(21) Appl. No.: 16/242,570

(22) Filed: Jan. 8, 2019

(65) Prior Publication Data

US 2019/0217933 A1 Jul. 18, 2019

(30) Foreign Application Priority Data

Jan. 12, 2018 (JP) ..... 2018-003625

(51) Int. Cl.
*B63C 9/125* (2006.01)
*B63C 9/18* (2006.01)
*B63C 9/00* (2006.01)

(52) U.S. Cl.
CPC ..... *B63C 9/1255* (2013.01); *B63C 9/18* (2013.01); *B63C 2009/007* (2013.01)

(58) Field of Classification Search
CPC ..... B63C 9/105; B63C 9/1055; B63C 9/125; B63C 9/1255; B63C 9/15; B63C 9/155; B63C 9/18
See application file for complete search history.

(56) References Cited

U.S. PATENT DOCUMENTS 2,615,182 A * 10/1952 Podell ..... B63C 9/155 441/113
2,784,426 A * 3/1957 Boyle ..... B63C 9/1255 441/111
2,876,468 A * 3/1959 Fraebel ..... B63C 9/1255 441/119
3,103,022 A * 9/1963 Harding ..... B63C 9/1255 441/94
3,117,326 A * 1/1964 Bernhardt ..... B63C 9/1255 441/118

(Continued)

FOREIGN PATENT DOCUMENTS

JP 5-80995 U 11/1993
JP 2004-42816 A 2/2004

(Continued)

OTHER PUBLICATIONS

Notice of Reasons for Refusal issued in corresponding Japanese Patent Application No. 2018-003625 dated Jun. 25, 2019, with machine translation.

*Primary Examiner* — Ajay Vasudeva
(74) *Attorney, Agent, or Firm* — Troutman Pepper Hamilton Sanders LLP

(57) ABSTRACT

In order to provide a small life jacket that is unlikely to obstruct movement of a wearer, a life jacket includes: a float member that changes from an uninflated state to an inflated state with gas being supplied to an internal portion thereof; a cover that covers the float member in the uninflated state; a connecting member and a waist belt as a wearable member that is to be worn by a wearer; a guide member that is linked to the connecting member and the waist belt; and a slidable member that is linked to the float member and that slides along the guide member.

8 Claims, 7 Drawing Sheets

(56) References Cited

U.S. PATENT DOCUMENTS

| | | | | |
|---|---|---|---|---|
| 6,346,022 | B1 * | 2/2002 | Swanby | B63C 9/1255 441/106 |
| 6,620,010 | B2 * | 9/2003 | Noonan | B63C 9/1255 441/106 |
| 7,631,728 | B2 * | 12/2009 | Hill | A62B 35/0018 182/3 |
| 8,696,398 | B2 * | 4/2014 | Steger | B63C 9/1255 441/106 |
| 2009/0239428 | A1 * | 9/2009 | Berchten | A62B 33/00 441/80 |

FOREIGN PATENT DOCUMENTS

| | | | |
|---|---|---|---|
| JP | 2004-098936 | A | 4/2004 |
| JP | 2005-1399 | A | 1/2005 |
| JP | 2007-90943 | A | 4/2007 |

* cited by examiner

LIFE JACKET

CROSS-REFERENCE TO RELATED APPLICATIONS

The present application claims priority from Japanese Patent Application No. 2018-003625 filed on Jan. 12, 2018, the entire contents of which are hereby incorporated by reference.

BACKGROUND OF THE INVENTION

1. Field of the Invention

The present invention relates to a life jacket including a float member that changes from an uninflated state to an inflated state with gas being supplied to an internal portion thereof, a cover that covers the float member in the uninflated state, and a wearable member that is to be worn by a wearer.

2. Description of Related Art

JP 2004-98936A discloses a life jacket including a float member (a float 2) that changes from an uninflated state to an inflated state with gas being supplied to an internal portion thereof, a cover (a cover 1) that covers the float member (the float 2) in the uninflated state, and a wearable member (a belt 5) that is worn by a wearer (a wearer 4). The constituent elements and reference numerals shown in parentheses are as in JP 2004-98936A.

In order to provide a life jacket that is unlikely to obstruct movement of the wearer, the life jacket of JP 2004-98936A has a size that has been reduced by accommodating the float member (the float 2) in the uninflated state in the cover (the cover 1).

However, the life jacket of JP 2004-98936A has to be provided with the cover (the cover 1) over a relatively large area in conformity with the position of the float member (the float 2) that is attached to the wearable member (the belt 5) such that the float member is located at an ideal position in the inflated state. In this regard, it cannot be said that the size of the life jacket of JP 2004-98936A has been sufficiently reduced, and there is room for improvement.

SUMMARY OF THE INVENTION

Thus, there is a demand for a small life jacket that is unlikely to obstruct movement of a wearer.

In view of these circumstances, a life jacket is characterized by including:

- a float member that changes from an uninflated state to an inflated state with gas being supplied to an internal portion thereof,
- a cover that covers the float member in the uninflated state;
- a wearable member that is to be worn by a wearer;
- a guide member that is linked to the wearable member; and
- a slidable member that is linked to the float member and that slides along the guide member.

With these characteristics, when changing the float member between the uninflated state and the inflated state, the slidable member is slid along the guide member, and thus the portion of the float member that is linked to the slidable member can be moved along the guide member. Accordingly, the float member can be folded in a compact size and accommodated in the cover, by sliding the slidable member to the position suited for the float member to be folded in a compact size in the uninflated state. When the float member changes to the inflated state, the slidable member slides to the position in conformity with the shape of the float member in the inflated state, and thus the portion of the float member that is linked to the slidable member moves along the guide member linked to the wearable member. Accordingly, the float member in the inflated state is properly worn by a wearer. Thus, it is possible to reduce the size of the float member in the uninflated state and the cover that covers the float member, and thus it is possible to realize a small life jacket that is unlikely to obstruct movement of a wearer.

DETAILED DESCRIPTION OF THE INVENTION

1. First Embodiment

Figure 1:
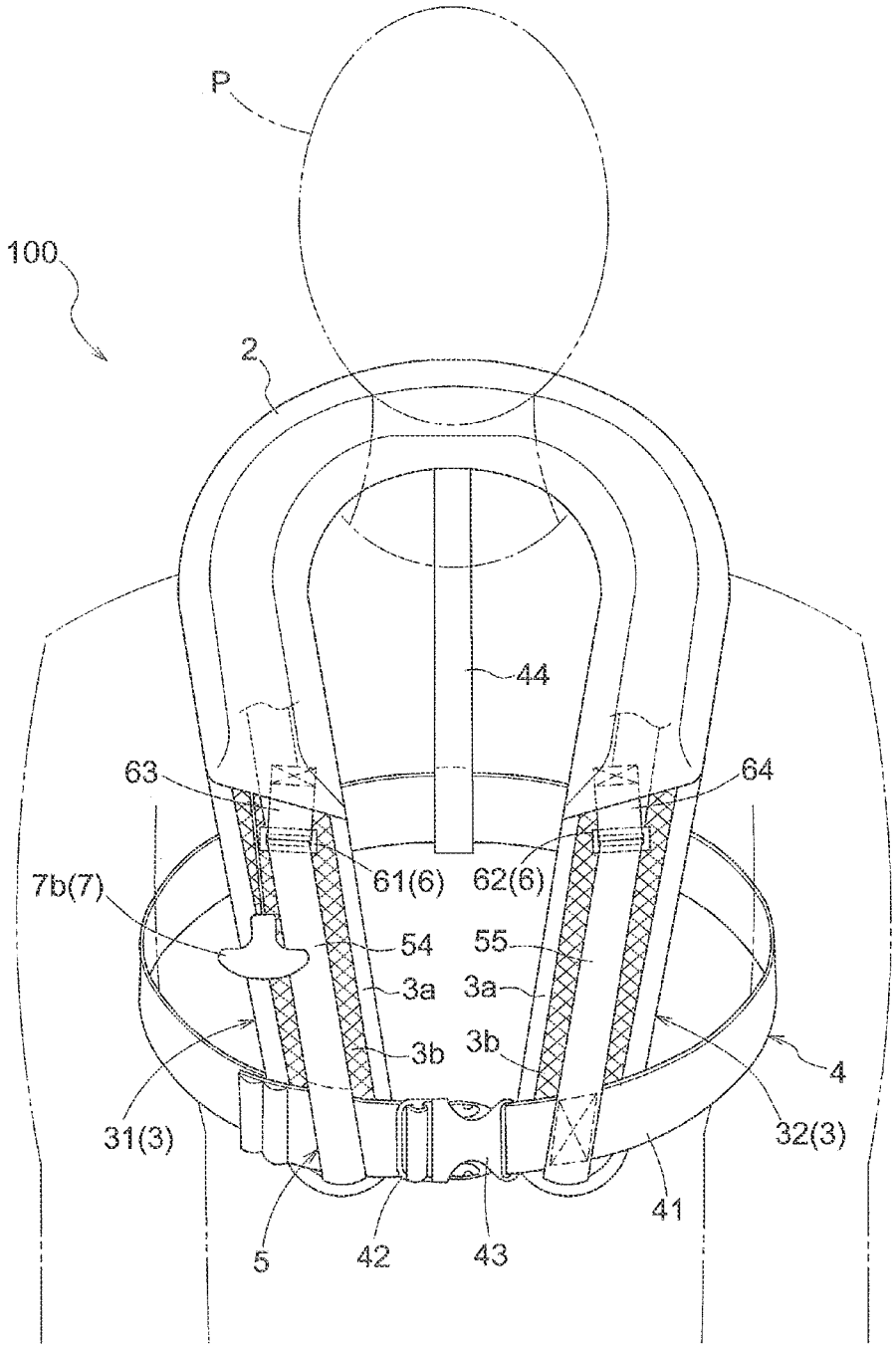
FIG. 1 is a view showing a state in which a life jacket according to a first embodiment is worn by a wearer.

Hereinafter, a life jacket 100 according to the first embodiment will be described with reference to the drawings. As shown in FIG. 1, the life jacket 100 according to the first embodiment is configured to be put around the neck of a wearer P, and to be worn around the waist of the wearer P. The life jacket 100 according to the first embodiment includes a float member 1, a cover 2, a connecting member 3, a waist belt 4, a guide member 5, and a slidable member 6.

Figure 2:
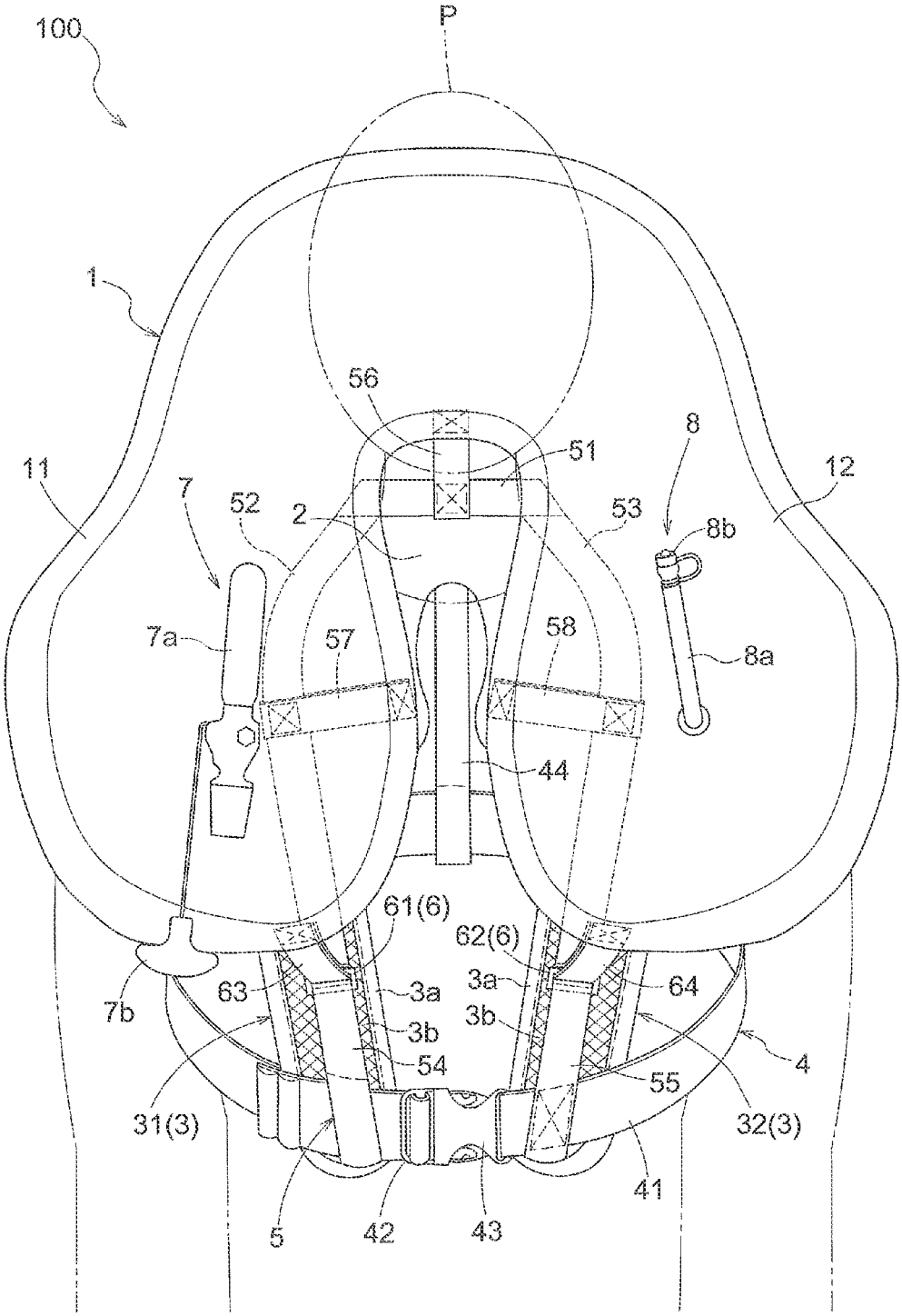
FIG. 2 is a view showing a state in which a float member of the life jacket according to the first embodiment is in an inflated state.

The float member 1 is a sealed bag that changes from an uninflated state to an inflated state with gas being supplied to an internal portion thereof. As shown in FIG. 1, the float member 1 in the uninflated state is folded and accommodated in the cover 2. As shown in FIG. 2, the float member 1 in the inflated state projects out of the cover 2 and is exposed to the outside. In this embodiment, the float member 1 in the inflated state extends from the back side of the neck of the wearer P to the front of both sides of the chest. Accordingly, the float member 1 has a first float portion 11 located on one arm side (the right arm side, in the example shown in the drawings) of the wearer P in the inflated state, and a second float portion 12 located on the other arm side (the left arm side, in the example shown in the drawings) of the wearer P in the inflated state. The first float portion 11 and the second float portion 12 are continuous with each other on the neck side of the wearer P, and are away from each other on the chest side of the wearer P. That is to say, in the inflated state, the float member 1 is in the shape of a C, and is located such that the first float portion 11 and the second float portion 12 surround the wearer P.

As shown in FIG. 2, the float member 1 is provided with a gas filling apparatus 7 for inflating the float member 1 by supplying gas to the internal portion of the float member 1. As the gas filling apparatus 7, those with various known configurations can be used. In this embodiment, the gas filling apparatus 7 includes a cylinder 7*a* containing compressed gas such as carbon dioxide, a supply device having a continuous hole continuous with the internal portion of the float member 1 and configured to, upon activation, supply the gas in the cylinder 7*a* into the float member 1, an automated activation device configured to, upon detection of dropping into water, automatically activate the supply device, and a manual activation device configured to activate the supply device in response to an operation of an operating portion 7*b*. There is no particular limitation on the location of the gas filling apparatus 7, but, in this example, in order to make the gas filling apparatus 7 unlikely to obstruct movement of the wearer P, the gas filling apparatus 7 is located on the surface of the first float portion 11 that is opposite to the side facing the wearer P when the float member 1 is in the inflated state. The gas filling apparatus 7 also may be a manual gas filling apparatus configured to inflate the float member 1 only through a manual operation using the operating portion 7*b*, not including the above-described automated activation device.

Furthermore, the float member 1 is provided with a filling amount adjusting tube 8. In this embodiment, the filling amount adjusting tube 8 includes a tube 8*a* continuous with the internal portion of the float member 1, a cap 8*b* configured to be fitted to clog an opening end of the tube 8*a*, and a check valve (not shown) provided inside the tube 8*a* near its opening end and configured to allow only gas that flows into the float member 1 to pass therethrough. The wearer P blows a breath into the float member 1 through the filling amount adjusting tube 8 when the inflation level of the float member 1 is not sufficient, and releases gas out of the float member 1 by opening the check valve when the inflation level of the float member 1 is excessive. Accordingly, the wearer P can adjust the inflation level of the float member 1. There is no limitation on the location of the filling amount adjusting tube 8, as long as the wearer P can easily blow a breath into the float member 1. In this example, the filling amount adjusting tube 8 is located on the surface of the second float portion 12 that is opposite to the side facing the wearer P when the float member 1 is in the inflated state.

Figure 3:
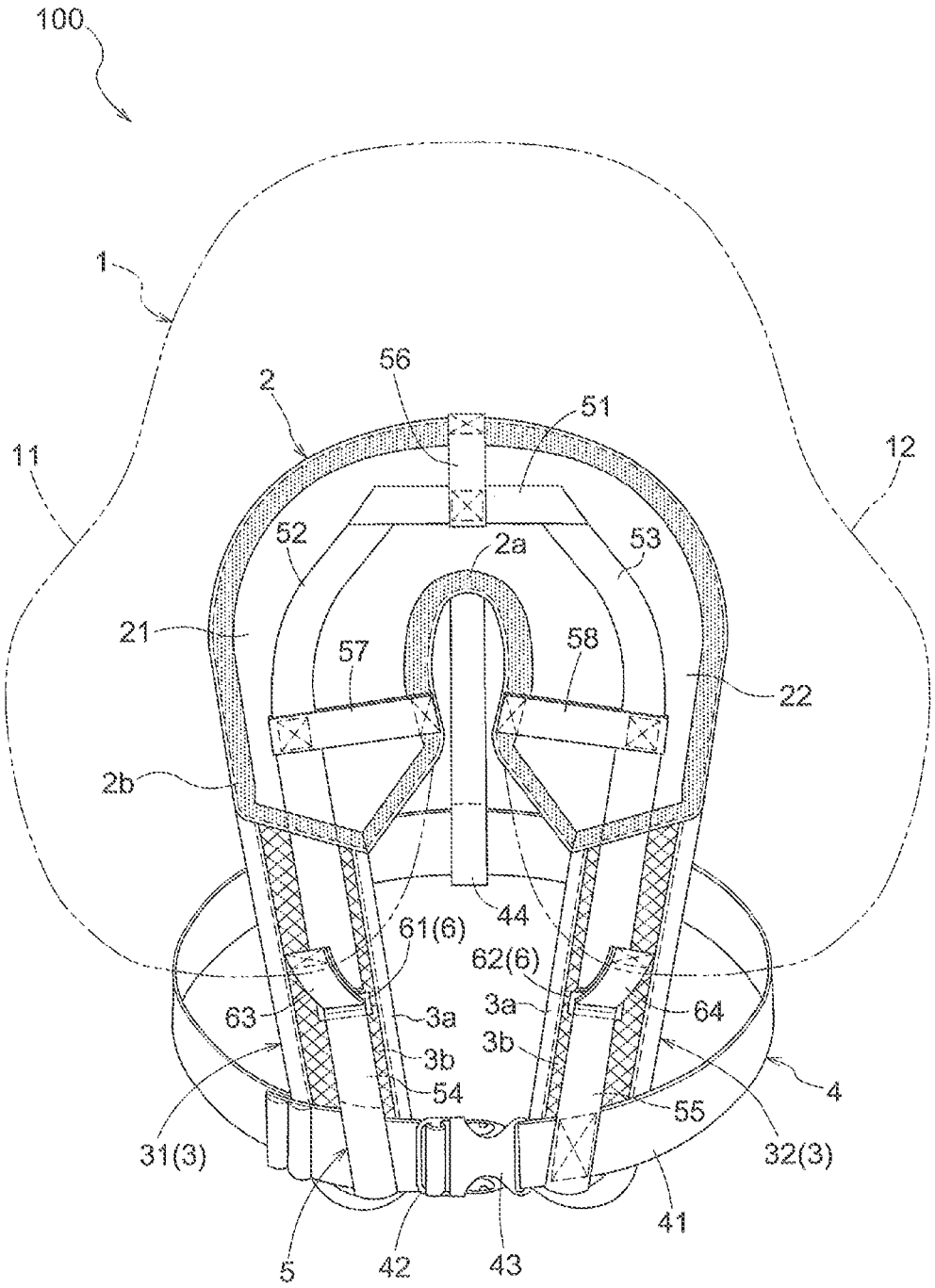
FIG. 3 is a view showing a state in which the float member of the life jacket according to the first embodiment is in an inflated state.

As shown in FIG. 1, the cover 2 can accommodate the float member 1 in the uninflated state. As shown in FIG. 3, in this embodiment, the cover 2 is formed in the shape of a band extending from the back side of the neck of the wearer P to the front of both sides of the chest, and also functions as a "wearable member" that is to be worn by the wearer P. Below, for the sake of ease of description, the surface of the cover 2 that faces the wearer P when the float member 1 is in the inflated state is referred to as a "wearing face", and the surface that is opposite to the side facing the wearer P is referred to as a "non-wearing face". Note that the "wearing face" and the "non-wearing face" are defined in a similar manner also in the connecting member 3 and the waist belt 4.

As shown in FIG. 3, in this embodiment, the cover 2 includes a first cover portion 21 located on one arm side (the right arm side, in the example shown in the drawings) of the wearer P, and a second cover portion 22 located on the other arm side (the left arm side, in the example shown in the drawings) of the wearer P. The first cover portion 21 and the second cover portion 22 are continuous with each other on the neck side of the wearer P, and are away from each other on the chest side of the wearer P. That is to say, the cover 2 is in the shape of a C as in the case of the float member 1, and is located such that the first cover portion 21 and the second cover portion 22 surround the wearer P.

Furthermore, in this embodiment, the cover 2 can be formed into the shape of a cylinder that can accommodate the float member 1 in the uninflated state. Specifically, as shown in FIG. 3, an inner edge hook-and-loop fastener component 2*a* and an outer edge hook-and-loop fastener component 2*b*, which are a pair of hook-and-loop fastener components that can be attached to and detached from each other, are provided along the edge of the non-wearing face of the cover 2. The inner edge hook-and-loop fastener component 2*a* is located closer to the inner side than the outer edge hook-and-loop fastener component 2*b* is, when the float member 1 is in the inflated state. The cover 2 can be formed into the shape of a cylinder by fastening the inner edge hook-and-loop fastener component 2*a* and the outer edge hook-and-loop fastener component 2*b* to each other. The fastening strength between the pair of hook-and-loop fastener components is set such that the pair of hook-and-loop fastener components are peeled apart from each other through inflation of the float member 1.

The connecting member 3 is a member that connects the cover 2 and the waist belt 4, and functions as a "wearable member" that is to be worn by the wearer P. In the example shown in the drawings, the connecting member 3 includes a frame member 3*a* located along the edge of the connecting member 3, and a mesh member 3*b* located inside the frame member. The connecting member 3 includes a first connecting portion 31 secured to the first cover portion 21, and a second connecting portion 32 secured to the second cover portion 22. Note that, in this application, "secure" refers to sewing, adhering, or the like. The first connecting portion 31 extends from the portion secured to the first cover portion 21 to the waist belt 4, and the second connecting portion 32 extends from the portion secured to the second cover portion 22 to the waist belt 4.

The waist belt 4 is a belt that is worn around the waist of the wearer P, and functions as a "wearable member" that is to be worn by the wearer P. The waist belt 4 includes a band-like belt main body 41, and a male buckle 42 and a female buckle 43 that are respectively provided on both ends of the belt main body 41 and that can be attached to and detached from each other. At least one of the male buckle 42 and the female buckle 43 is provided with a length adjusting mechanism for adjusting the length of the belt main body 41. The wearer P can properly wear the waist belt 4 around his or her waist, by putting the belt main body 41 around the waist, engaging the male buckle 42 with the female buckle 43, and adjusting the length of the belt main body 41.

In this embodiment, the belt main body 41 includes a back-side connecting member 44. The back-side connecting member 44 extends from the belt main body 41 toward the cover 2, and is secured to the cover 2. In the example shown in the drawings, the back-side connecting member 44 is formed in the shape of a band, wherein one end in the longitudinal direction of the back-side connecting member 44 has a loop through which the belt main body 41 is inserted, and the other end in the longitudinal direction of the back-side connecting member 44 is sewn to the center (the boundary between the first cover portion 21 and the second cover portion 22) of the wearing face of the cover 2 and the center of a later-described center wearable member linking portion 51. Accordingly, one end in the longitudinal direction of the back-side connecting member 44 slides along the belt main body 41.

The guide member 5 is linked to the "wearable member" that is to be worn by the wearer P, and is a member separate from the "wearable member". In this embodiment, the guide member 5 is formed in the shape of a band, and is linked to the cover 2, the connecting member 3, and the waist belt 4 functioning as the "wearable member". In this embodiment, the guide member 5 is located along the body surface of the wearer P. In this embodiment, the guide member 5 includes a center wearable member linking portion 51, a first wearable member linking portion 52, a second wearable member linking portion 53, a first guide portion 54, and a second guide portion 55.

The center wearable member linking portion 51 is located at the center of the guide member 5, and is secured to the cover 2. The center wearable member linking portion 51 is linked to the float member 1 via a center linking member 56. That is to say, the center linking member 56 functions as a "linking member" that links the float member 1 and the guide member 5. In this embodiment, the center linking member 56 is located on the back side of the wearer P. In the example shown in the drawings, the center linking member 56 is formed in the shape of a band, wherein one end in the longitudinal direction of the center linking member 56 is sewn to the center (the boundary between the first float portion 11 and the second float portion 12) of the float member 1. In a state in which the center wearable member linking portion 51 is positioned between the center linking member 56 and the cover 2, the other end in the longitudinal direction of the center linking member 56, the center (the boundary between the first cover portion 21 and the second cover portion 22) of the cover 2, and the center wearable member linking portion 51 are sewn to each other. Accordingly, in the example shown in the drawings, the center linking member 56 links the float member 1 and the guide member 5 while restricting a change in the positional relationship therebetween.

Furthermore, the center wearable member linking portion 51 extends toward the first cover portion 21 and the second cover portion 22, and is connected to the first wearable member linking portion 52 and the second wearable member linking portion 53. In the example shown in the drawings, the center wearable member linking portion 51 is formed in one piece with the first wearable member linking portion 52 and the second wearable member linking portion 53.

The first wearable member linking portion 52 is located on one arm side (the right arm side, in the example shown in the drawings) of the wearer P, and is secured to the first cover portion 21. The first wearable member linking portion 52 is linked to the first float portion 11 via a first linking member 57. That is to say, the first linking member 57 functions as a "linking member" that links the float member 1 and the guide member 5. In the example shown in the drawings, the first linking member 57 is formed in the shape of a band, wherein one end in the longitudinal direction of the first linking member 57 is sewn to the portion of the first float portion 11 that faces the second float portion 12 when the float member 1 is in the inflated state. In a state in which the first wearable member linking portion 52 is positioned between the first linking member 57 and the cover 2, the other end in the longitudinal direction of the first linking member 57, the first cover portion 21, and the first wearable member linking portion 52 are sewn to each other. Accordingly, in the example shown in the drawings, the first linking member 57 links the float member 1 and the guide member 5 while restricting a change in the positional relationship therebetween.

Furthermore, the first wearable member linking portion 52 extends from the portion connected to the center wearable member linking portion 51, to the portion secured to the first cover portion 21 and the first connecting portion 31, and is connected to the first guide portion 54 at the secured portion. In the example shown in the drawings, the first wearable member linking portion 52 is formed in one piece with the first guide portion 54.

The second wearable member linking portion 53 is located on the other arm side (the left arm side, in the example shown in the drawings) of the wearer P, and is secured to the second cover portion 22. The second wearable member linking portion 53 is linked to the second float portion 12 via the second linking member 58. That is to say, the second linking member 58 functions as a "linking member" that links the float member 1 and the guide member 5. In the example shown in the drawings, the second linking member 58 is formed in the shape of a band, wherein one end in the longitudinal direction of the second linking member 58 is sewn to the portion of the second float portion 12 that faces the first float portion 11 when the float member 1 is in the inflated state. In a state in which the second wearable member linking portion 53 is positioned between the second linking member 58 and the cover 2, the other end in the longitudinal direction of the second linking member 58, the second cover portion 22, and the second wearable member linking portion 53 are sewn to each other. Accordingly, in the example shown in the drawings, the second linking member 58 links the float member 1 and the guide member 5 while restricting a change in the positional relationship therebetween.

Furthermore, the second wearable member linking portion 53 extends from the portion connected to the center wearable member linking portion 51, to the portion secured to the second cover portion 22 and the second connecting portion 32, and is connected to the second guide portion 55 at the secured portion. In the example shown in the drawings, the second wearable member linking portion 53 are formed in one piece with the second guide portion 55.

The first guide portion 54 is located on the non-wearing face of the first connecting portion 31. In the example shown in the drawings, the first guide portion 54 is located on the mesh member **3*b* of the first connecting portion 31, and extends from the portion connected to the first wearable member linking portion 52, to the portion intersecting the belt main body 41. The portion of the first guide portion 54 that intersects the belt main body 41 has a loop through which the belt main body 41 is inserted. Accordingly, the end of the first guide portion 54 on the side that is opposite to the portion connected to the first wearable member linking portion 52 slides along the belt main body 41. The portion of the first guide portion 54 that intersects the belt main body 41 is sewn to the first connecting portion 31 at two portions between which the belt main body 41** is positioned.

The second guide portion 55 is located on the non-wearing face of the second connecting portion 32. In the example shown in the drawings, the second guide portion 55 is located on the mesh member **3*b* of the second connecting portion 32, and extends from the portion connected to the second wearable member linking portion 53, to the portion intersecting the belt main body 41. The portion of the second guide portion 55 that intersects the belt main body 41 is secured to the belt main body 41. In this example, in a state in which the belt main body 41 is positioned between the second guide portion 55 and the second connecting portion 32, the second guide portion 55, the second connecting portion 32, and the belt main body 41** are sewn to each other.

With this configuration, in the life jacket 100 according to this embodiment, the waist belt 4 that is worn around the waist of the wearer P, and the guide member 5 that is worn over the area from the back side of the neck of the wearer P to the abdomen side and that is linked to the waist belt 4 have a function of linking the wearer P and the float member 1 and preventing them from coming off each other when the float member 1 is in the inflated state on the water surface. Thus, the waist belt 4 and the guide member 5 are each made of a material that can ensure a necessary tensile strength.

The slidable member 6 is linked to the float member 1, and is configured to slide along the guide member 5. In this embodiment, the slidable member 6 includes a first slidable portion 61 and a second slidable portion 62.

The first slidable portion 61 is attached to the first guide portion 54 so as to slide along the first guide portion 54. In the example shown in the drawings, the first slidable portion 61 is formed in the shape of a quadrangular ring (rectangular ring), and the first guide portion 54 is inserted through the first slidable portion 61. The first slidable portion 61 is linked to the first float portion 11 via a first slidable linking portion 63. In the example shown in the drawings, the first slidable linking portion 63 is formed in the shape of a band, and is inserted through the rectangular ring-like first slidable portion 61. Both ends in the longitudinal direction of the first slidable linking portion 63 are sewn to the portion of the first float portion 11 that is at the lower end when the float member 1 is in the inflated state.

The second slidable portion 62 is attached to the second guide portion 55 so as to slide along the second guide portion 55. In the example shown in the drawings, the second slidable portion 62 is formed in the shape of a quadrangular ring (rectangular ring), and the second guide portion 55 is inserted through the second slidable portion 62. The second slidable portion 62 is linked to the second float portion 12 via a second slidable linking portion 64. In the example shown in the drawings, the second slidable linking portion 64 is formed in the shape of a band, and is inserted through the rectangular ring-like second slidable portion 62. Both ends in the longitudinal direction of the second slidable linking portion 64 are sewn to the portion of the second float portion 12 that is at the lower end when the float member 1 is in the inflated state.

As shown in FIG. 1, in the uninflated state, the float member 1 is accommodated in the cover 2 in a state of being folded. Meanwhile, the first slidable portion 61 and the second slidable portion 62 are located on the outer side of the cover 2 even when the float member 1 is in the uninflated state, in order to suppress the possibility that the slidable portions are caught on the cover 2 when sliding along the guide member 5 in accordance with inflation of the float member 1.

Figure 4:
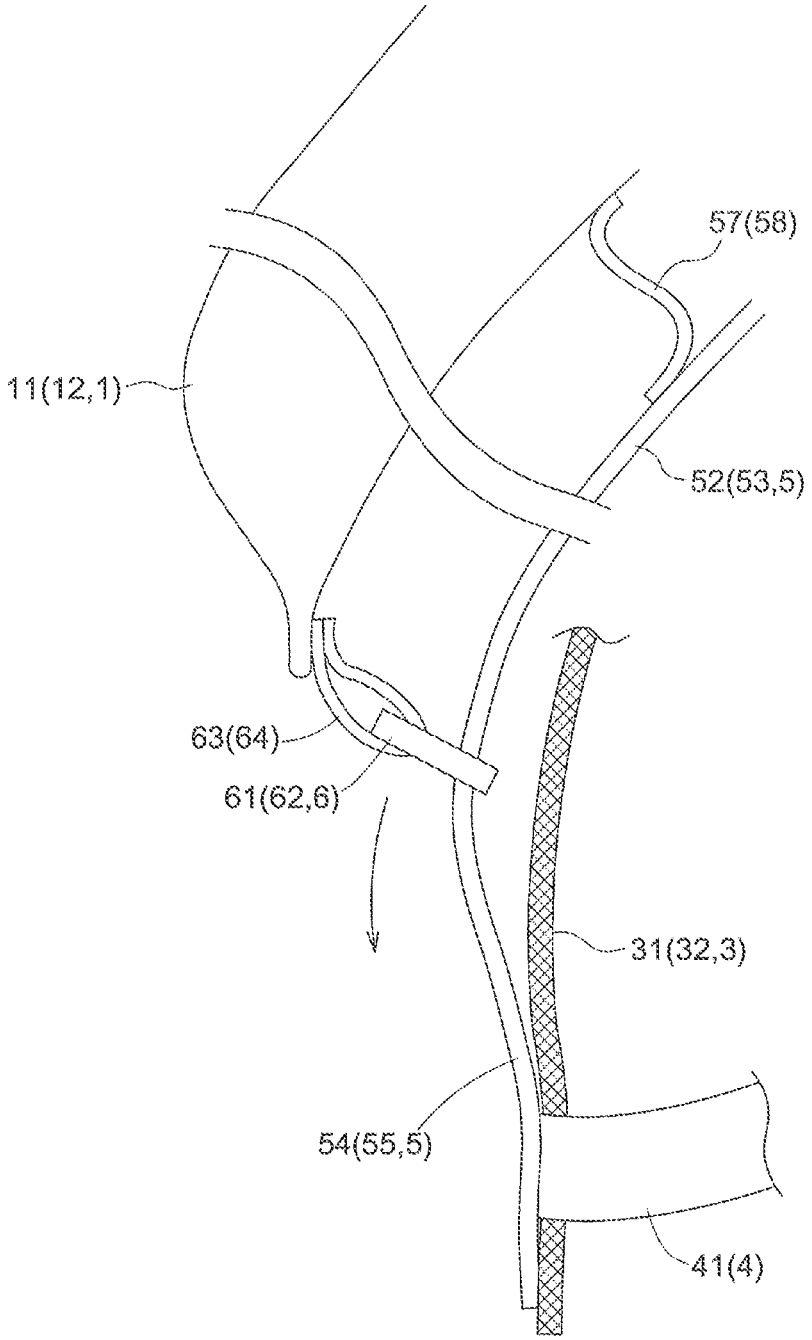
FIG. 4 is a view showing a state in which a slidable member of the life jacket according to the first embodiment slides along a guide member.

As shown in FIG. 4, the first slidable portion 61 is guided by the first guide portion 54 to slide between the first guide portion 54 and the first connecting portion 31. The second slidable portion 62 is guided by the second guide portion 55 to slide between the second guide portion 55 and the second connecting portion 32. That is to say, in this embodiment, the connecting member 3 functions not only as the "wearable member" but also as a "sliding support member" located between the guide member 5 and the wearer P along the guide member 5.

Furthermore, in this embodiment, the first guide portion 54 is located along the side of the first connecting portion 31 that is opposite to the side facing the wearer P, and the second guide portion 55 is located along the side of the second connecting portion 32 that is opposite to the side facing the wearer P. That is to say, the guide member 5 is located along the side of the connecting member 3 as the "wearable member" that is opposite to the side facing the wearer P.

As shown in FIG. 4, in accordance with a change of the float member 1 from the uninflated state to the inflated state, the slidable member 6 linked to the float member 1 slides along the guide member 5 in a direction away from the linking members 56, 57, and 58. In this embodiment, when the float member 1 changes from the uninflated state to the inflated state, the first slidable portion 61 slides along the first guide portion 54 in a direction away from the first linking member 57 (downward, in the example shown in the drawings), and the second slidable portion 62 slides along the second guide portion 55 in a direction away from the second linking member 58 (downward, in the example shown in the drawings). Accordingly, in this embodiment, the first slidable portion 61 is linked to the portion of the first float portion 11 that is away from the first linking member 57 when the float member 1 is in the inflated state, and the second slidable portion 62 is linked to the portion of the second float portion 12 that is away from the second linking member 58 when the float member 1 is in the inflated state. That is to say, the slidable member 6 is linked to the position that is away from the "linking member" when the float member 1 is in the inflated state.

2. Second Embodiment

Hereinafter, a life jacket 100 according to the second embodiment will be described with reference to the drawings. The life jacket 100 according to the second embodiment is different from the life jacket 100 according to the first embodiment in that it is configured to be worn only around the waist of the wearer P. Below, a description will be given mainly on the difference from the foregoing first embodiment. It is assumed that those not described in particular are as in the foregoing first embodiment.

Figure 5:
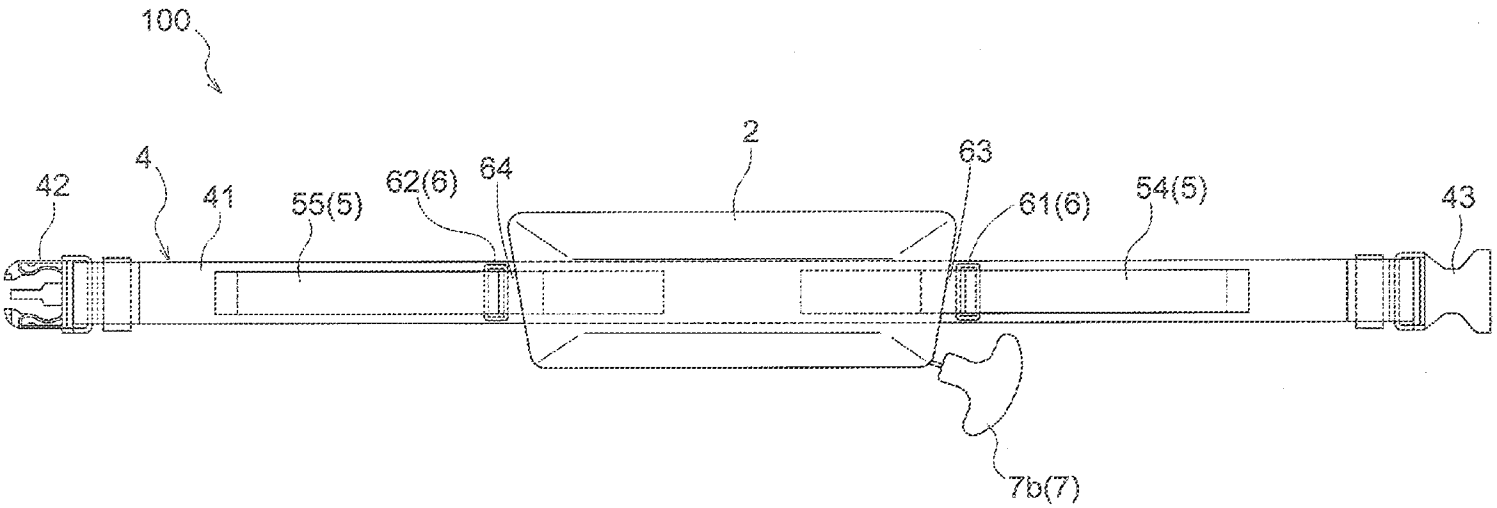
FIG. 5 is a front view of a life jacket according to a second embodiment.

As shown in FIG. 5, the life jacket 100 according to the second embodiment includes the float member 1, the cover 2, the waist belt 4, the guide member 5, and the slidable member 6.

Figure 7:
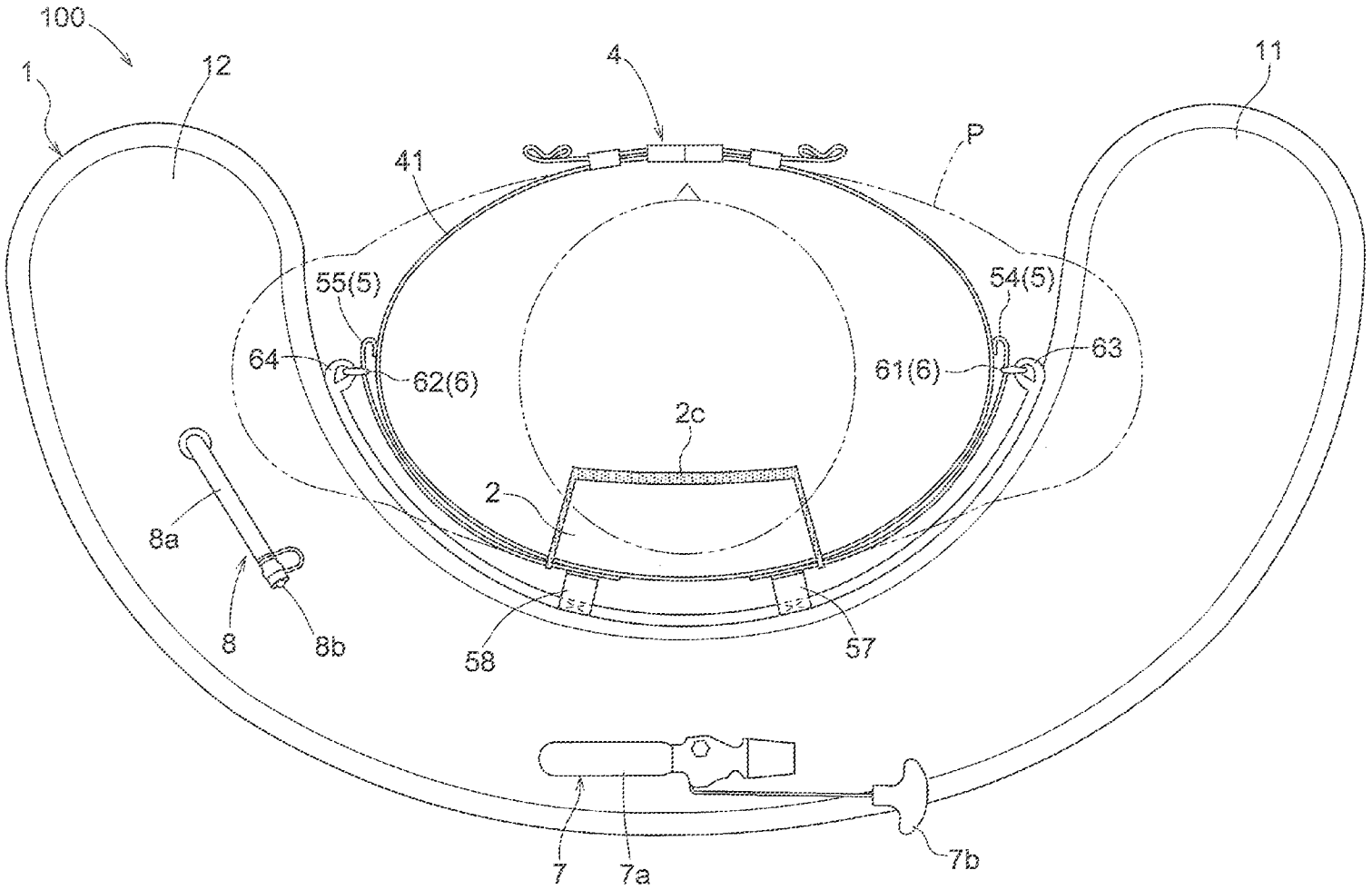
FIG. 7 is a plan view showing a state in which a float member of the life jacket according to the second embodiment is in an inflated state.

As shown in FIG. 7, in this embodiment, the float member 1 in the inflated state extends from the back side of the waist of the wearer P to both sides of the waist, and includes the first float portion 11 and the second float portion 12. The first float portion 11 and the second float portion 12 are continuous with each other on the back side of the waist of the wearer P, and are away from each other on both sides of the waist of the wearer P. That is to say, in the inflated state, the float member 1 is in the shape of a C, and is located such that the first float portion 11 and the second float portion 12 surround the wearer P.

Figure 6:
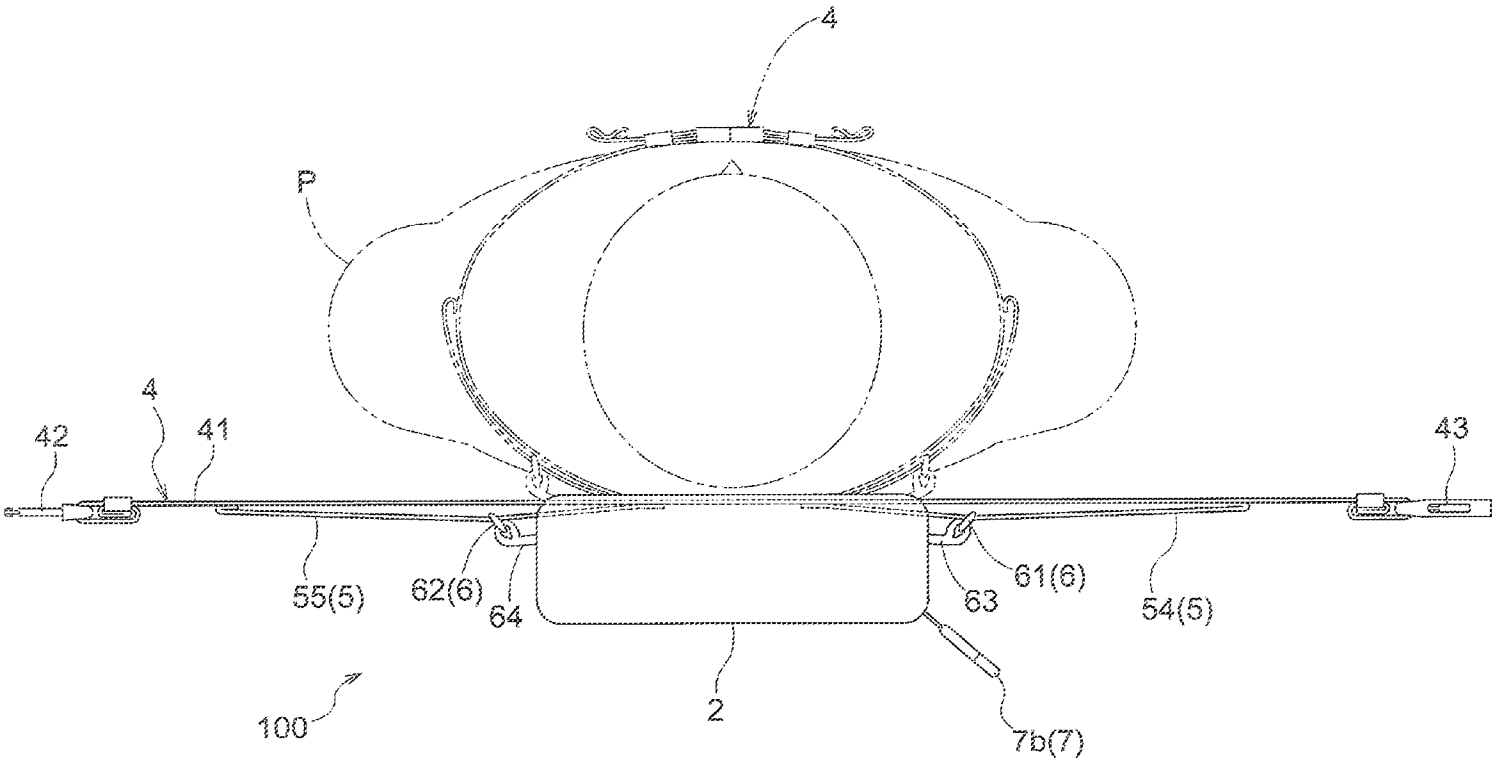
FIG. 6 is a plan view showing a state in which the life jacket according to the second embodiment is worn by a wearer.

As shown in FIG. 6, in this embodiment, the cover 2 is located on the back side of the waist of the wearer P, and has a size that does not allow the cover 2 to reach the left and right sides of the waist of the wearer P. As in the foregoing first embodiment, a pair of hook-and-loop fastener components 2*c* that can be attached to and detached from each other are provided along the edge of the non-wearing face of the cover 2 according to this embodiment, and the cover 2 can be formed into the shape of a cylinder that can accommodate the float member 1 in the uninflated state.

The waist belt 4 functions as a "wearable member" that is to be worn by the wearer P also in this embodiment. As shown in FIG. 7, in this embodiment, the cover 2 is attached to the belt main body 41 of the waist belt 4. In this embodiment, the cover 2 does not have to function as the "wearable member", and may be attachable to and detachable from the belt main body 41.

In this embodiment, the guide member 5 is linked to the waist belt 4 functioning as the "wearable member". In this embodiment, the guide member 5 is located along the body surface of the wearer P. In this embodiment, the guide member 5 includes the first guide portion 54 and the second guide portion 55.

As shown in FIG. 6, in this embodiment, the first guide portion 54 extends along the belt main body 41, and is located on the non-wearing face of the belt main body 41 on one arm side (the right arm side, in the example shown in the drawings) of the wearer P. Both ends in the longitudinal direction of the first guide portion 54 are secured to the belt main body 41. The second guide portion 55 extends along the belt main body 41, and is located on the non-wearing face of the belt main body 41 on the other arm side (the left arm side, in the example shown in the drawings) of the wearer P. Both ends in the longitudinal direction of the second guide portion 55 are secured to the belt main body 41. In the example shown in the drawings, the first guide portion 54 and the second guide portion 55 are located away from each other, and extend from the back side of the waist of the wearer P respectively to the right and left sides of the waist.

As shown in FIG. 7, in this embodiment, the belt main body 41 and the first guide portion 54 are linked to the first float portion 11 via the first linking member 57. In this embodiment, the first linking member 57 is located on the back side of the wearer P. In the example shown in the drawings, the first linking member 57 is formed in the shape of a band, wherein one end in the longitudinal direction of the first linking member 57 is sewn to the portion of the first float portion 11 that is on the back side of the waist of the wearer P when the float member 1 is in the inflated state. In a state in which the cover 2, the belt main body 41, the first guide portion 54, and the first linking member 57 are sequentially layered from the wearer P side, the cover 2, the belt main body 41, the portion of the first guide portion 54 that is on the back side of the wearer P, and the other end in the longitudinal direction of the first linking member 57 are sewn to each other.

Furthermore, the belt main body 41 and the second guide portion 55 are linked to the second float portion 12 via the second linking member 58. In this embodiment, the second linking member 58 is located on the back side of the wearer P. In the example shown in the drawings, the second linking member 58 is formed in the shape of a band, wherein one end in the longitudinal direction of the second linking member 58 is sewn to the portion of the second float portion 12 that is on the back side of the waist of the wearer P when the float member 1 is in the inflated state. In a state in which the cover 2, the belt main body 41, the second guide portion 55, and the second linking member 58 are sequentially layered from the wearer P side, the cover 2, the belt main body 41, the portion of the second guide portion 55 that is on the back side of the wearer P, and the other end in the longitudinal direction of the second linking member 58 are sewn to each other.

In this embodiment, the first slidable portion 61 of the slidable member 6 is linked to the first float portion 11 via the first slidable linking portion 63. In the example shown in the drawings, the first slidable linking portion 63 is located on the portion of the first float portion 11 that faces the right side of the waist of the wearer P when the float member 1 is in the inflated state. The second slidable portion 62 of the slidable member 6 is linked to the second float portion 12 via the second slidable linking portion 64. In the example shown in the drawings, the second slidable linking portion 64 is located on the portion of the second float portion 12 that faces the left side of the waist of the wearer P when the float member 1 is in the inflated state.

As shown in FIG. 5, also in this embodiment, the float member 1 in the uninflated state is accommodated in the cover 2 in a state of being folded. Meanwhile, the first slidable portion 61 and the second slidable portion 62 are located on the outer side of the cover 2 even when the float member 1 is in the uninflated state, in order to suppress the possibility that the slidable portions are caught on the cover 2 when sliding along the guide member 5 in accordance with inflation of the float member 1.

As shown in FIG. 7, the first slidable portion 61 is guided by the first guide portion 54 to slide between the first guide portion 54 and the belt main body 41. The second slidable portion 62 is guided by the second guide portion 55 to slide between the second guide portion 55 and the belt main body 41. That is to say, in this embodiment, the waist belt 4 functions not only as the "wearable member" but also as a "sliding support member" located between the guide member 5 and the wearer P along the guide member 5.

Furthermore, in this embodiment, the first guide portion 54 and the second guide portion 55 are located along the side of the belt main body 41 that is opposite to the side facing the wearer P. That is to say, the guide member 5 is located along the side of the waist belt 4 as the "wearable member" that is opposite to the side facing the wearer P.

As shown in FIG. 7, in accordance with a change of the float member 1 from the uninflated state to the inflated state, the slidable member 6 linked to the float member 1 slides along the guide member 5 in a direction away from the linking members 57 and 58. Also in this embodiment, when the float member 1 changes from the uninflated state to the inflated state, the first slidable portion 61 slides along the first guide portion 54 in a direction away from the first linking member 57 (rightward from the back side of the waist of the wearer P), and the second slidable portion 62 slides along the second guide portion 55 in a direction away from the second linking member 58 (leftward from the back side of the waist of the wearer P). Accordingly, also in this embodiment, the first slidable portion 61 is linked to the portion of the first float portion 11 that is away from the first linking member 57 when the float member 1 is in the inflated state, and the second slidable portion 62 is linked to the portion of the second float portion 12 that is away from the second linking member 58 when the float member 1 is in the inflated state. That is to say, the slidable member 6 is linked to the position that is away from the "linking member" when the float member 1 is in the inflated state.

3. Other Embodiments (1) In the foregoing embodiments, the configuration in which the slidable member 6 includes two slidable portions 61 and 62 respectively located on the right and left arm sides of the wearer P was described as an example. However, there is no limitation to such a configuration, and it is also possible that the slidable member 6 has only one slidable portion, or has three or more slidable portions. In the foregoing embodiments, the cover 2, the connecting member 3, the guide member 5, and the slidable member 6 each have two portions respectively located on the right and left arm sides of the wearer P, but, also in these constituent elements, there is no limitation on the number of portions.

(2) In the foregoing embodiments, the configuration in which the cover 2, the connecting member 3, and the waist belt 4 each function as a "wearable member" was described as an example. However, there is no limitation to such a configuration, and any "wearable member" may be used as long as it is worn so as to be in contact with the body of the wearer P.

(3) In the foregoing embodiments, the configuration in which the "linking member" (the center linking member 56, the first linking member 57, and the second linking member 58) links the float member 1 and the guide member 5 while restricting a change in the positional relationship therebetween was described as an example. However, there is no limitation to such a configuration, and it is also possible that the "linking member" links the float member 1 and the guide member 5 while allowing the float member 1 to move relative to the guide member 5. In this case, the float member 1 can be moved to any position.

(4) In the foregoing embodiments, the configuration in which the guide member 5 is formed in the shape of a band was described as an example. However, there is no limitation to such a configuration, as long as the slidable member 6 can slide along the guide member 5. For example, it is also possible that the guide member 5 is a cord-like member such as a wire or a rope, or that the guide member 5 is a rail-like member having a groove and the slidable member 6 is a member configured to slide along the groove.

(5) In the foregoing embodiments, the configuration in which the slidable member 6 slides downward and the configuration in which the slidable member 6 slides from the back side of the waist of the wearer P to the right and left sides were described as an example. However, the direction in which the slidable member 6 slides is not limited to such a configuration. For example, it is also possible that the slidable member 6 slides upward in accordance with a change of the float member 1 from the uninflated state to the inflated state. For example, it is also possible that, contrary to the foregoing first embodiment, the float member 1 accommodated in a state of being folded near the chest of the wearer P in the uninflated state is inflated toward the neck side of the wearer P. In this case, it is possible to facilitate sliding movement of the slidable member 6, using the buoyancy of the float member 1 during a change from the uninflated state to the inflated state in water.

(6) In the foregoing embodiments, the configuration in which the center linking member 56 as the "linking member" is located on the back side of the wearer P and the configuration in which the first linking member 57 and the second linking member 58 as the "linking member" are located on the back side of the wearer P were described as an example. However, there is no limitation to such a configuration, and it is also possible that the "linking member" is located, for example, at the abdomen, the chest, the side, or the like of the wearer P, instead of the back side of the wearer P.

(7) In the foregoing embodiments, the configuration in which the connecting member 3 functions as a "sliding support member" and the configuration in which the waist belt 4 functions as a "sliding support member" were described as an example. However, there is no limitation to such a configuration, and, for example, it is also possible that another member may be provided as a "sliding support member". Furthermore, it is also possible that the "sliding support member" is not provided.

(8) In the foregoing embodiments, the configuration in which the slidable member 6 is located on the outer side of the cover 2 when the float member 1 is in the uninflated state was described as an example. However, there is no limitation to such a configuration, and it is also possible that the slidable member 6 is covered by the cover 2 when the float member 1 is in the uninflated state.

(9) In the foregoing embodiments, the life jacket 100 (the first embodiment) that is put around the neck of the wearer P and worn around the waist of the wearer P and the life jacket 100 (the second embodiment) that is worn around the waist of the wearer P were described as an example. However, there is no limitation to the life jacket 100 with such a configuration, and the life jacket 100 may be worn by the wearer P at any section of the body of the wearer P. For example, it is also possible that the life jacket 100 is worn about the chest or the back of the wearer P.

(10) In the foregoing embodiments, the configuration in which the slidable member 6 slides along the guide member 5 by inflating the float member 1 by causing the gas filling apparatus 7 to supply gas to the internal portion of the float member 1 was described as an example. However, there is no limitation to such a configuration, and, for example, it is also possible that the wearer P takes the float member 1 out of the cover 2, and blows a breath into the float member 1 through the filling amount adjusting tube 8, thereby inflating the float member 1.

(11) In the foregoing embodiments, the configuration in which the float member 1 is inflated by causing the gas filling apparatus 7 to supply gas to the internal portion of the float member 1 was described as an example. However, there is no limitation to such a configuration, and, for example, it is also possible that the float member 1 is provided with an elastic member such as a rubber or a spring, and inflation of the float member 1 is facilitated using the restoring force of the elastic member.

(12) In the foregoing embodiments, the configuration in which the first guide portion 54 and the second guide portion 55 in the shape of bands are respectively inserted through the first slidable portion 61 and the second slidable portion 62 in the shape of rectangular rings linked to the float member 1, and the first slidable portion 61 and the second slidable portion 62 respectively slide along the first guide portion 54 and the second guide portion 55 was described as an example. However, there is no limitation to such a configuration, and, for example, it is also possible that a zipper including a pair of rows of meshing teeth and a slider is provided on the float member 1 and the guide member 5. Specifically, one row of meshing teeth is provided on the float member 1, and the other row of meshing teeth is provided on the guide member 5. When the wearer P operates the slider so as to close the zipper while taking the float member 1 out of the cover 2, the float member 1 is fixed along the guide member 5.

(13) The configurations disclosed in the foregoing embodiments can be used in combination with configurations disclosed in other embodiments, as long as there are no contradictions. The embodiments disclosed in this specification are, in all respects, illustrative and not limiting. Various modifications may be made without departing from the gist of the invention.

4. Summary of Foregoing Embodiments

Hereinafter, the summary of the life jacket described above will be described.

A life jacket includes:

a float member that changes from an uninflated state to an inflated state with gas being supplied to an internal portion thereof, a cover that covers the float member in the uninflated state;

a wearable member that is to be worn by a wearer;

a guide member that is linked to the wearable member; and a slidable member that is linked to the float member and that slides along the guide member.

With this configuration, when changing the float member between the uninflated state and the inflated state, the slidable member is slid along the guide member, and thus the portion of the float member that is linked to the slidable member can be moved along the guide member. Accordingly, the float member can be folded in a compact size and accommodated in the cover, by sliding the slidable member to the position suited for the float member to be folded in a compact size in the uninflated state. When the float member changes to the inflated state, the slidable member slides to the position in conformity with the shape of the float member in the inflated state, and thus the portion of the float member that is linked to the slidable member moves along the guide member linked to the wearable member. Accordingly, the float member in the inflated state is properly worn by a wearer. Thus, it is possible to reduce the size of the float member in the uninflated state and the cover that covers the float member, and thus it is possible to realize a small life jacket that is unlikely to obstruct movement of a wearer.

Furthermore, it is preferable that the life jacket further includes a linking member that links the float member and the guide member, wherein the slidable member is linked to a portion of the float member that is away from the linking member when the float member is in the inflated state.

With this configuration, in the float member in the inflated state, the portion that is linked to the linking member and the portion that is linked to the slidable member are located away from each other. Accordingly, the float member in the inflated state can be located over a relatively large area. Thus, it is easy for a wearer to properly wear the float member in the inflated state. The movement of the entire float member with respect to the guide member is restricted by the linking member. Thus, it is possible to easily stabilize the posture of the wearer on the water surface.

In the configuration including the linking member, it is preferable that the linking member is located on the back of the wearer.

With this configuration, the portion of the float member that is linked to the linking member is located on the back side (the back) of the wearer. The portion of the float member that is linked to the linking member is covered by the cover when the float member is folded in the uninflated state. Since this portion is located on the back side (the back) of the wearer, the size of the portion, of the float member in the uninflated state and the cover that covers the float member, that is located on the abdomen side (the front) of the wearer can be reduced. Thus, it is possible to realize a small life jacket that is, in the uninflated state, more unlikely to obstruct movement of a wearer.

Furthermore, it is preferable that, when the float member changes from the uninflated state to the inflated state, the slidable member slides along the guide member in a direction away from the linking member.

With this configuration, when the float member folded in the uninflated state changes to the inflated state, the float member is inflated while spreading from the side close to the linking member, toward the abdomen side (the front) of the wearer. Thus, it is possible to realize a small life jacket that is, in the uninflated state, unlikely to obstruct movement of a wearer, and that allows the wearer to properly wear the float member in the inflated state.

Furthermore, it is preferable that the life jacket further includes a sliding support member that is located along the guide member between the guide member and the wearer, wherein the slidable member is guided by the guide member to slide between the guide member and the sliding support member.

With this configuration, the sliding support member is located between the guide member and the wearer. Accordingly, the possibility that sliding movement of the slidable member is obstructed by the slidable member being caught on clothing of the wearer or the like when sliding along the guide member can be suppressed. Thus, the reliability of inflation of the float member that is linked to the slidable member can be improved.

Furthermore, it is preferable that the guide member is located along a side of the wearable member that is opposite to a side facing the wearer.

With this configuration, the wearable member is located between the guide member and the wearer, and thus the wearable member can function as a sliding support member that supports sliding of the slidable member. Accordingly, the possibility that sliding movement of the slidable member is obstructed by the slidable member being caught on clothing of the wearer or the like when sliding along the guide member can be suppressed. Thus, the reliability of inflation of the float member that is linked to the slidable member can be improved.

Furthermore, it is preferable that the float member includes a first float portion that is located on one arm side of the wearer in the inflated state, and a second float portion that is located on the other arm side of the wearer in the inflated state, and the slidable member includes a first slidable portion that is linked to the first float portion, and a second slidable portion that is linked to the second float portion.

With this configuration, the float member in the inflated state is located such that the portion on one arm side of the wearer and the portion on the other arm side surround the wearer. Thus, it is possible to easily stabilize the posture of the wearer on the water surface.

Furthermore, it is preferable that, in the uninflated state, the float member is accommodated in the cover in a state of being folded, and the slidable member is located on an outer side of the cover.

With this configuration, when the float member changes from the uninflated state to the inflated state, the cover is unlikely to obstruct sliding movement of the slidable member. Thus, the reliability of inflation of the float member that is linked to the slidable member can be improved.

Furthermore, it is preferable that the guide member is located along a body surface of the wearer.

With this configuration, when the float member changes from the uninflated state to the inflated state, the slidable member slides along the body surface of the wearer. Accordingly, the float member in the inflated state is located along the body surface of the wearer. Thus, it is possible to easily stabilize the posture of the wearer on the water surface.

The technique according to this disclosure can be applied to a life jacket including a float member that changes from an uninflated state to an inflated state with gas being supplied to an internal portion thereof, a cover that covers the float member in the uninflated state, and a wearable member that is to be worn by a wearer.

What is claimed is:

1. A life jacket including:

a float member configured to extend around a neck of a wearer and change from an uninflated state to an inflated state with gas being supplied to an internal portion thereof;

a cover that covers the float member in the uninflated state;

a wearable member that is configured to be worn by a waist of the wearer;

a guide member that is linked to the wearable member; and a slidable member that is linked to the float member, wherein when the life jacket is in use, said slidable member is positioned to freely slide along the guide member to vary a distance between the float member and the wearable member when the float member changes from the uninflated state to the inflated state, wherein the float member includes a first float portion that is located on one arm side of the wearer in the inflated state, and a second float portion that is located on the other arm side of the wearer in the inflated state, the cover is formed in a shape of a band configured to extend from a back side of a neck of the wearer to a front of both sides of a chest of the wearer, the wearable member includes a waist belt, the guide member includes a first guide portion with a lower end that is linked to the waist belt, and a second guide portion with a lower end that is linked to the waist belt, and the slidable member includes a first slidable portion that is linked to a lower end of the first float portion and slides along the first guide portion, and a second slidable portion that is linked to a lower end of the second float portion and slides along the second guide portion.

2. The life jacket according to claim 1, further comprising a linking member that links the float member and the guide member, wherein the slidable member is linked to a portion of the float member that is away from the linking member when the float member is in the inflated state.

3. The life jacket according to claim 2, wherein the linking member is located on the back of the wearer.

4. The life jacket according to claim 3, wherein, when the float member changes from the uninflated state to the inflated state, the slidable member slides along the guide member in a direction away from the linking member.

5. The life jacket according to claim 1, further comprising a sliding support member that is located along the guide member between the guide member and the wearer, wherein the slidable member is guided by the guide member to slide between the guide member and the sliding support member.

6. The life jacket according to claim 1, wherein the guide member is located along a side of the wearable member that is opposite to a side facing the wearer.

7. The life jacket according to claim 1, wherein, in the uninflated state, the float member is accommodated in the cover in a state of being folded, and the slidable member is located on an outer side of the cover.

8. The life jacket according to claim 1, wherein the guide member is located along a body surface of the wearer.

* * * * *